United States Patent [19]

Jefferson et al.

[11] 4,362,140

[45] Dec. 7, 1982

[54] LIQUID FUEL INJECTION PUMPS

[75] Inventors: John R. Jefferson, Rainham; Frank Cunliffe, Doddington, both of England

[73] Assignee: Lucas Industries Limited, Birmingham, England

[21] Appl. No.: 193,086

[22] Filed: Oct. 2, 1980

[30] Foreign Application Priority Data

Oct. 20, 1979 [GB] United Kingdom ..... 7936479

[51] Int. Cl.[3] ..... F02D 31/00

[52] U.S. Cl. ..... 123/366; 123/387; 123/388; 417/462

[58] Field of Search ..... 123/366, 365, 385–388; 417/462, 214, 221

[56] References Cited

U.S. PATENT DOCUMENTS 3,338,168 8/1967 Davis ..... 417/462
3,847,509 11/1974 Bonin ..... 417/462
3,936,233 2/1976 Bonin ..... 417/462
4,098,249 7/1978 Mowbray ..... 417/462

FOREIGN PATENT DOCUMENTS 500365 2/1939 United Kingdom ..... 123/366

*Primary Examiner*—Charles J. Myhre
*Assistant Examiner*—Magdalen Moy

[57] ABSTRACT

A fuel injection pump of the rotary distributor type including a pump plunger the outward movement of which can be limited by an angularly adjustable stop ring to determine the maximum amount of fuel supplied by the pump. The stop ring is moveable from a first position to a second position to enable the pump to supply an excess amount of fuel for starting the engine. A first torsion spring biases the stop ring to the first position and a second torsion spring biases the ring to the second position and is stronger than the first torsion spring. Means is provided to remove the force exerted by the second torsion spring when the supply of the extra amount of fuel is no longer required. This means can be a fluid pressure operable piston.

3 Claims, 3 Drawing Figures

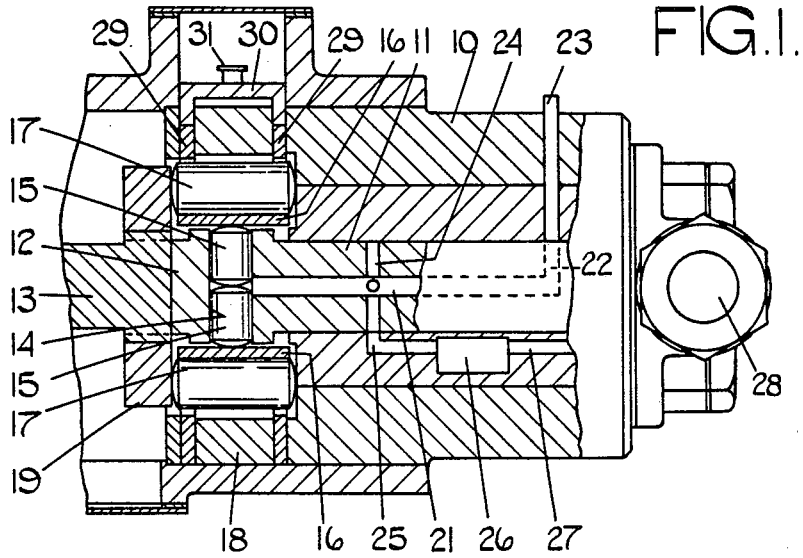
FIG.1.
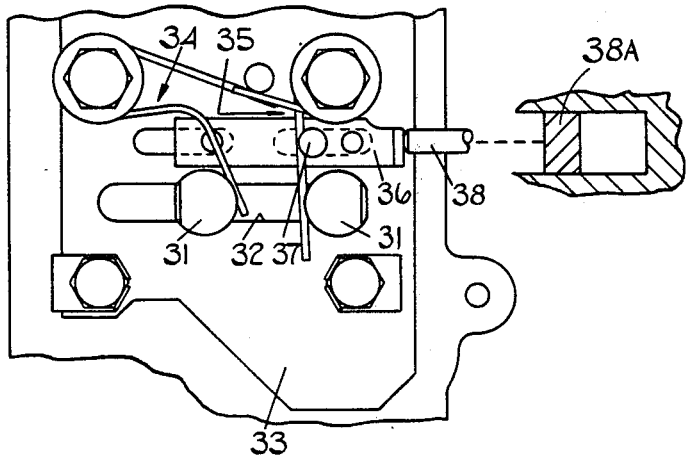
FIG.2.
FIG.3.
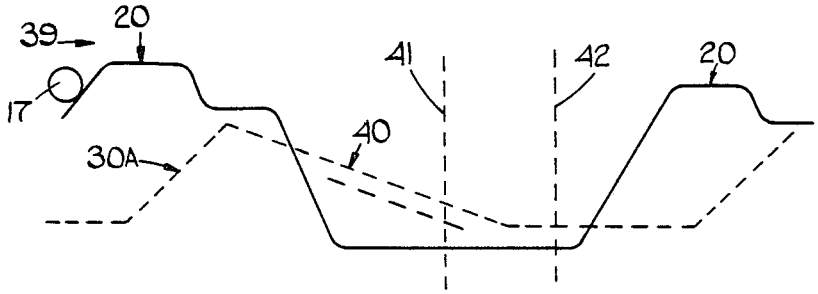

LIQUID FUEL INJECTION PUMPS

This invention relates to a liquid fuel injection pump for supplying fuel to a multi-cylinder internal combustion engine and of the kind comprising a rotary distributor member housed in a body and driven in use in timed relationship with an associated engine, a transverse bore formed in the distributor member and a plunger in said bore, a delivery passage communicating with the bore and arranged to register in turn with outlets in the body, as the distributor member rotates and during successive inward movement of the plunger, a cam ring surrounding the distributor member and having inwardly extending cam lobes for imparting said inward movements to the plunger, fuel supply means for supplying fuel to the bore during at least part of the time when the plunger is allowed to move outwardly by the cam lobes, said fuel supply means including an inlet port in the body to which fuel is supplied from a low pressure source, means for controlling the amount of fuel supplied through said port and stop means for limiting the outward movement of the plunger.

Such pumps are well known in the art and two forms of stop means are known. The first form of stop means is mounted on the distributor member and is therefore not adjustable during operation of the pump. With this form of stop means it is not possible without increasing the complexity of the pump, to obtain an extra amount of fuel for starting purposes. The second type of stop means is adjustable and takes the form of at least one ring mounted in the body of the pump and which has a profile on its internal surface for engagement by a part associated with the plunger to limit the outward movement of the plunger. Means is provided to adjust the ring to vary the maximum amount of fuel which can be supplied to the bore.

The present invention is concerned with a pump of the kind specified having the second type of stop means and has for its object to provide such a pump in a simple and convenient form.

According to the invention in a pump of the kind specified said stop means comprises a ring mounted in the body, said ring having a profile on its internal surface for engagement by a part associated with the plunger to limit the outward movement of the plunger, means for adjusting said ring so that the amount of fuel which can be supplied to said bore can be varied, said means including a movable member, a first resilient means biasing said member to a first position in which the ring is set for the normal maximum amount of fuel supply to the engine, a second resilient means stronger than said first resilient means, acting on said member to urge the member to a second position in which the ring is set for an extra or excess amount of fuel supply to the engine, and means operable in use to remove the force exerted by said second resilient means on the member whereby the member can move under the action of said first resilient means to said first position.

One example of a pump in accordance with the invention will now be described with reference to the accompanying drawings in which:

FIG. 1 is a diagrammatic sectional side elevation of a pump in accordance with the invention;

FIG. 2 is a plan view of part of the pump not seen in FIG. 1; and

FIG. 3 is a diagram of the cam lobe profile and the profile of a stop ring forming part of the pump shown in FIG. 1.

Referring to FIG. 1 of the drawings the pump comprises a multi-part body 10 in which is mounted a rotary cylindrical distributor member 11, the distributor member has an enlarged portion 12 which is driven from a drive shaft 13. Formed in the distributor member 11 is a diametrically disposed bore 14 in which is mounted a pair of plungers 15 and at their outer ends the plungers engage rollers 17 for engagement with the internal peripheral surface of an annular cam ring 18 which surrounds the enlarged portion 12 of the distributor member.

The cam ring 18 has a plurality of inwardly extending cam lobes the profile of which is seen at 20 in FIG. 3. The shoes 16 are carried in slots formed in a sleeve 19 which is secured to or forms part of the drive shaft 13. Formed within the distributor member is a longitudinal passage 21 which at one end communicates with a radially disposed delivery passage 22. The passage 22 is disposed to register in turn with outlet ports 23 formed in the body and connected in use to the injection nozzles of the associated engine. Moreover, the longitudinal passage 21 communicates with a plurality of inlet passages 24 formed in the distributor member and arranged to communicate in turn with an inlet port 25 which is formed in the body. The inlet port 25 communicates by way of a fuel control device 26 which may be a throttle, with a fuel supply passage 27. This passage communicates with a low pressure supply pump the rotary part of which is conveniently mounted on the distributor member and the pump draws fuel through an inlet 28.

The apparatus so far described is conventional and during the time that the rollers and plungers are moved inwardly by the action of the cam lobes, fuel is displaced through an outlet 23. As the distributor member rotates further the delivery passage 22 is moved out of register with an outlet 23 and one of the inlet passages 24 moves into register with the inlet port 25. Fuel can now flow to the bore 14, the amount of fuel being controlled by the device 26. Thereafter the cycle is repeated and fuel is supplied to the outlets in turn during successive inward movements of the plungers.

In order to control the maximum amount of fuel which can be supplied by the pump to the associated engine, there is mounted in the body a pair of stop rings 29, these rings being disposed on opposite sides of the cam ring. The rings 29 are angularly movable within the body and have an internal profile as shown at 30A in FIG. 3. The stop rings 29 are interconnected by means of a bridging member 30 which is provided with a pair of upstanding pegs 31.

The pegs 31 extend through a slot 32 formed in a plate 33 as shown in FIG. 2. The pegs 31 are engaged by a pair of resilient means respectively. The first resilient means which is in the form of a helical torsion spring 34, engages one of the pegs to bias the bridging member to a first position which as will be more fully explained, is the position at which a normal maximum amount of fuel is supplied to the engine. The second peg 31 is biased by a second resilient means in the form of a helical torsion spring 35, towards a second position in which the bridging member assumes a position to set the rings 29 so that an excess of fuel will be supplied by the pump to the associated engine.

The spring 35 is stronger than the spring 34 and in the absence of any external force therefore the bridging member assumes the second position. This is the position shown in FIG. 2.

In order to permit the bridging member to move to the first position means is provided to remove the force exerted by the spring 35 and as shown in FIG. 2, this comprises a plate member 36 which is guided for movement in slots in the plate 33 and which has an upstanding peg 37 for engagement with the tail of the spring 35 which contacts the peg 31. The plate 36 is movable by means of a fluid pressure operable piston 38A by way of a push member 38. Conveniently the fluid pressure operable piston 38A is responsive to the outlet pressure of the low pressure pump and therefore only when sufficient pressure has been developed once the engine has started, will the piston move the push member 38 and the plate 36 towards the left as seen in FIG. 2, thereby removing the force exerted by the spring 35. The bridging member 30 can then move to the aforesaid first position.

Turning now to FIG. 3 a roller 17 is shown engaging one of the cam lobes. The direction of movement of the roller as it is driven round the cam ring is shown by the arrow 39 and it will be seen to be in engagement with the leading flank of the cam lobe 20. The roller will also move upwardly as shown in FIG. 3 and this corresponds to inward movement of the associated plunger 15. Fuel is therefore being supplied through an outlet 23. When the roller reaches the crest of the cam lobe there is a delay during which no movement of the plunger takes place. This is followed by limited outward movement of the plunger to reduce the pressure in the various passages within the pump and also to reduce the pressure in the pipe-line connecting the outlet with the nozzle. Again there is a short delay during which time the delivery passage 22 moves out of register with an outlet port 23 and an inlet passage 24 moves into register with the inlet port 25. The cam lobe falls to the base circle of the cam and the plunger can therefore move outwardly as fuel is supplied from the low pressure source.

The internal profile of the stop rings is shown at 30A and the important portion thereof is a portion 40 with which the rollers 17 can engage during the period when fuel can be supplied to the bore. The dotted line 41 indicates the closure of the inlet port 25 to an inlet passage whilst the further dotted line 42 indicates the opening of the delivery port to an outlet 23. Assuming for the moment that the device 26 is set so that there is substantially no restriction to the flow of fuel, then the rollers will engage the portion 40 of the internal peripheral surface of the stop rings to restrain the outward movement of the rollers and therefore the plungers. Once the inlet port has been closed then no further fuel can be supplied to the bore and the position of the rollers and plungers will be such that the maximum amount of fuel is supplied by the pump to the associated engine. The rollers will therefore leave the profile of the stop ring and will float until they again engage the leading flanks of the lobes 20. It will be noted that before they do this the delivery passage 22 will be brought into communication with an outlet 23. Furthermore, it should be noted that if the device 26 is set to allow a restricted supply of fuel, then the rollers may not engage with the portion 40 of the stop rings.

As mentioned in the description relative to FIGS. 1 and 2 the stop rings are movable angularly and with reference to FIG. 3 the upper dotted line represents the so called first position of the bridging member and the stop rings whilst the lower dotted line represents the second position. It will be seen that when the bridging member and stop rings are in the second position; the rollers and therefore the plungers can move outwardly an additional amount so that the extra or excess amount of fuel is supplied to the associated engine providing the device 26 is set so that the additional quantity of fuel can flow into the bore during the time available.

The push member 38 may be operated by an electromagnetic device instead of a fluid pressure operable piston and the energisation of the device may be controlled by a suitable switch.

We claim:

1. A liquid fuel injection pump for supplying fuel to a multi-cylinder internal combustion engine and of the kind comprising a rotary distributor member housed in a body and driven in use in timed relationship with an associated engine, a transverse bore formed in the distributor member and a plunger in said bore, a delivery passage communicating with the bore and arranged to register in turn with outlets in the body, as the distributor member rotates and during successive inward movement of the plunger, a cam ring surrounding the distributor member and having inwardly extending cam lobes for imparting said inward movements to the plunger, fuel supply means for supplying fuel to the bore during at least part of the time when the plunger is allowed to move outwardly by the cam lobes, said fuel supply means including an inlet port in the body to which fuel is supplied from a low pressure source, means for controlling the amount of fuel supplied through said port and stop means for limiting the outward movement of the plunger, said stop means comprising a ring mounted in the body for angular movement, said ring having a profile on its internal surface for engagement by a part associated with the plunger to limit the outward movement of the plunger, means effecting angular adjustment of said ring so that the amount of fuel which can be supplied to said bore can be varied, said means including a movable member, a first coiled torsion spring continuously biasing said member to a first position in which the ring is set for the normal maximum amount of fuel supply to the engine, a second coiled torsion spring stronger than said first spring continuously acting on said member to oppose the force produced by the first coiled torsion spring to continuously urge the member toward a second position in which the ring is set for an extra or excess amount of fuel supply to the engine, and means operable in use to force said member in the same direction as the first torsion spring so that the force exerted by said second spring on the member is overcome and the member is moved to said first position.

2. A liquid fuel injection pump for supplying fuel to a multi-cylinder internal combustion engine and of the kind comprising a rotary distributor member housed in a body and driven in use in timed relationship with an associated engine, a transverse bore formed in the distributor member and a plunger in said bore, a delivery passage communicating with the bore and arranged to register in turn with outlets in the body, as the distributor member rotates and during successive inward movement of the plunger, a cam ring surrounding the distributor member and having inwardly extending cam lobes for imparting said inward movements to the plunger, fuel supply means for supplying fuel to the bore during at least part of the time when the plunger is allowed to move outwardly by the cam lobes, said fuel supply means including an inlet port in the body to which fuel is supplied from a low pressure source, means for controlling the amount of fuel supplied through said port and stop means for limiting the outward movement of the plunger, said stop means comprising a ring mounted in the body, said ring having a profile on its internal surface for engagement by a part associated with the plunger to limit the outward movement of the plunger, means for adjusting said ring so that the amount of fuel which can be supplied to said bore can be varied, said means including a movable member, a first coiled torsion spring biasing said member to a first position in which the ring is set for the normal maximum amount of fuel supply to the engine, a second coiled torsion spring stronger than said first spring, acting on said member to urge the member to a second position in which the ring is set for an extra or excess amount of fuel supply to the engine, and means operable in use to remove the force exerted by said second spring on the member whereby the member can move under the action of said first spring to said first position, said means operable to remove the force comprising a slidable plate having a peg engageable with a tail of the second spring, and means for moving said plate whereby the tail is moved out of engagement with a part operatively connected to said ring.

3. A pump according to claim 2 in which the means for moving said plate comprises a fluid pressure operable piston responsive to the fuel pressure developed by said fuel supply means.

* * * * *